United States Patent [19]

Fink et al.

[11] Patent Number: 4,530,391

[45] Date of Patent: Jul. 23, 1985

[54] APPARATUS FOR THE PRODUCTION OF DIE-CAST PARTS WITH ADJUSTABLE PISTON TRAVEL LENGTH AND INITIAL AND FINAL POSITIONS

[75] Inventors: Roland Fink; Hubert Bartos, both of Winterbach; Herbert Noschilla, Schorndorf; Walter Klingenstein, Urbach, all of Fed. Rep. of Germany

[73] Assignee: Oskar Frech GmbH & Co., Schorndorf-Weiler, Fed. Rep. of Germany

[21] Appl. No.: 541,700

[22] Filed: Oct. 13, 1983

[30] Foreign Application Priority Data

Oct. 15, 1982 [DE] Fed. Rep. of Germany ..... 3238202

[51] Int. Cl.[3] ..... B22D 17/32; B22D 17/18

[52] U.S. Cl. ..... 164/155; 164/312; 164/314

[58] Field of Search ..... 164/312, 313, 314, 315, 164/316, 317, 318, 113, 120, 155

[56] References Cited

U.S. PATENT DOCUMENTS

| | | | |
|---|---|---|---|
| 2,479,433 | 12/1946 | Tucker | 164/314 X |
| 3,601,180 | 8/1969 | Nef et al. | 164/315 |
| 4,252,176 | 2/1981 | Page | 164/155 |
| 4,354,545 | 10/1982 | Goldhammer | 164/313 |

FOREIGN PATENT DOCUMENTS

| | | | |
|---|---|---|---|
| 2019502 | 1/1972 | Fed. Rep. of Germany . | |
| 3044992 | 6/1982 | Fed. Rep. of Germany . | |
| 604623 | 4/1978 | U.S.S.R. | 164/314 |

*Primary Examiner*—Nicholas P. Godici
*Assistant Examiner*—Kenneth F. Berg
*Attorney, Agent, or Firm*—Burns, Doane, Swecker & Mathis

[57] ABSTRACT

An apparatus for the production of die-cast parts is described, wherein the melt is pressured under a low pressure into a die where it solidifies. A casting unit has a drive piston guided in a casting cylinder and connected to a casting piston. The casting piston is equipped with terminal stops in both directions. The casting piston, which has a large cross-section, is able to travel into a movable half of the die. The casting cylinder is displaceably supported on a guide in the direction of the axis of the drive piston, with the terminal stops being adjustable relative to the drive piston and relative to each other. A signal transducer is associated with the stroke path of the drive piston and detects the end position of the casting piston within the moving half of the die. Thus, in a so-called pressure mold casting process, different casting strokes may be effected with the same machine, and both the end of the stroke of the casting piston and the onset of the casting stroke may be adapted to different dies by an adjustment of the entire casting unit.

18 Claims, 6 Drawing Figures

APPARATUS FOR THE PRODUCTION OF DIE-CAST PARTS WITH ADJUSTABLE PISTON TRAVEL LENGTH AND INITIAL AND FINAL POSITIONS

BACKGROUND AND OBJECTS OF THE INVENTION

The invention concerns an apparatus for the production of die-cast parts in which the melt is pressured, with the aid of a casting piston under a low pressure, into a die comprising a moving half die and a stationary half die, within the melt solidifies.

The apparatus comprises a casting unit with a drive piston guided in a casting cylinder for the advance of the casting piston. Terminal stops are associated with the casting cylinder for both directions of the movement of the drive piston. The casting piston is aligned with the drive piston and is joined with it. The casting piston is guided in a short casting chamber with a large cross-section held on the stationary die platen, and is capable of being inserted into the movable half die mated with the moving dia platen, and pressing against the runner lug.

A process and apparatus for the production of die-cast parts is known in DE-AS 20 19 502, whereby die-cast parts as free of porosity as possible may be produced with the use of high casting pressure. The disadvantage of casting machines of this type involves the fact that the design of the dies to be employed is restricted by the prevailing high casting pressure and high casting velocities. Primarily, the sand cores used for many castings, for example in gravity die-casting, cannot be employed.

For this reason, a process has been proposed in DE-OS 30 44 992 in which only very low pressures are employed, i.e., lower by one to two orders of magnitude than those employed in pressure die-casting. To obtain the highest possible casting rates, large casting chamber cross-sections and large piston cross-sections are employed.

In the die-casting process for the known die-casting machines, the dies may be adpated to the machine, whereby it is possible, for example, to work with three standard casting members per machine type. However, this is not possible in the new process proposed in DE-OS 30 44 992, which may be designated as a type of pressure mold casting process. If, for example, sand cores are to be used, the filling pressure must be such that the sand cores are not displaced from their position. In order to be able to operate at a low pressure, a high filling degree in the casting chamber is desirable, which requires large casting piston diameters and short casting strokes. The new process further requires that each die have a runner system adapted to tendency of the material to solidify, i.e., the modulus of solidification, with the ingate placed at the region(s) of the die where the solidification modulus of the casting is the highest. These conditions thus render it necessary, in contrast to die-casting machines, to adapt the casting unit to the die. The disadvantage of the pressure mold casting process thus proposed is that always a relatively large effort must be expended on the side of the casting unit, when different castings are to be produced.

It is, therefore, the object of the present invention to provide an apparatus whereby it is possible to use a wide range of casting dies with a single machine, so that the new pressure mold casting process may be applied economically.

SUMMARY OF THE INVENTION

The invention involves (i) supporting the casting unit on guide means displaceably and adjustably in the direction of the axis of the drive piston, (ii) providing the rear terminal stop of the drive piston to be adjustable in the casting cylinder, and (iii) arranging a transducer adjacent the stroke path of the drive piston to detect the terminal position of the casting piston within the movable half of the die.

This arrangement has the advantage that different casting strokes may be effected with the same machine and that both the end of the casting piston stroke and the onset of the casting stroke may be adapted to different dies by an adjustment of the entire casting unit. The casting piston is thus adjustable both in its terminal position and its initial position. The surveillance of the stroke path and the detection of the end of the stroke provide the advantage that a second, higher casting pressure may be applied to the workpiece, in order to obtain an improved surface condition of the casting. Conveniently, the transducer is connected with an adjustable time delay element, which conducts the pulse coming from the transducer when the casting piston has attained its terminal position after filling the die and is pressing against the runner slug. The time delay device is connected to a device that amplifies the pressure acting on the drive piston. This arrangement results in the advantage that the delay time may be chosen long enough to assure that the higher pressure will actually be applied only when, for example, a sand core used in the mold can no longer be displaced, because it is already fully embedded in the material filled-in; the higher pressure is then counteracting the shrinkage by means of the additional supply of melt introduced by it.

It is particularly advantageous to provide the drive piston in the form of a double-acting piston with a piston rod that is protruding from both sides of the piston and has a smaller diameter on the side connected with the casting piston than on the side facing the terminal stop. This structural configuration makes it possible to obtain a high return force, in spite of a low casting force and with the same working pressure of the hydraulic medium that is used preferentially. The adjustable stop may be mounted on this rearwardly extended piston rod in a very simple manner, in that the piston rod is hollow on the stop side and a rotating spindle is extending into the hollow part. The spindle is equipped with a stop nut adjustable on the spindle, cooperating with the frontal side of the hollow part of the piston rod and guided on the casting cylinder in a manner fixed in rotation. The fixation in rotation may be obtained simply in that the stop nut is provided with a sliding block protruding unilaterally. The sliding block is displaceable in a groove guide extending parallel to the axis of the spindle. The sliding block, since it may be placed in a location not exposed to pressure, may be equipped with a display extending to the outside, for example in the form of a pointer, cooperating with a scale mounted on the casting cylinder to indicate the prevailing position of the terminal stop. However, the sliding block may further be provided with a terminal switch cooperating with the end of the piston rod, so that it will signal automatically the position of "casting piston in the rear" and may be used in the working process. The terminal switch is automatically adjusted when the terminal stop is reset by rotating the spindle. This arrangement of the casting unit yields the further advantage that upon the opening of the die, it is not necessary for the casting piston to pressure, as in die-casting, the slug from the casting chamber, followed by a so-called relaxation impact.

To adjust the longitudinal setting of the casting cylinder, it is simple and advantageous to hold it in a slide that is adjustable by means of a screw rod drive on the guide. A simple embodiment of this screw rod drive may comprise a rotatable shaft with a pinion, supported fixedly on the guide and cooperating with a tooth gear having a larger diameter. The tooth gear drives, in turn, two pinions located on the tooth gear and diametrically opposed to each other. The pinions effect the longitudinal displacement with the aid of a screw rod arrangement. This configuration has the further advantage that the slide may be equipped with a pointer to indicate the prevailing position of the casting cylinder on a scale, mounted stationarily on the guide joined to the machine stand.

The transducer provided for the detection of the stroke of the casting piston may be in the form of a path sensor measuring the advance of the casting piston. The sensor comprises an electromagnetically operating counter and pulse generator and cooperating with a rack, the teeth of which effect changes in the magnetic field detectable by the counter upon their passage. The rack may be joined fixedly with the piston rod, which may be effected in an extremely simple manner. The pulse generator is then connected through a delay element with a control valve to set the working pressure of the working medium, so that upon the arrival of the casting piston in the die (position: casting piston forward), after a certain period of time, the force applied by the casting piston on the runner slug in the die is increased, thereby obtaining the desired additional supply of the melt.

Since in the present apparatus for the production of die-cast parts, the casting piston is acting on the melt during the filling of the die with a low force and thus the process is operated with a slight casting force, no high locking forces are required on the locking part of the die. According to the invention, therefore, the locking part may be in the form of a frictionally locking system in contrast to the positively locking lever system of the die-casting machine. In an apparatus of the aforementioned type, with a closing unit having a closing cylinder and a closing piston guided in the cylinder for the displacement of a moving die platen supported on columns, with respect to the stationary die platen, therefore, the closing unit is supported in a longitudinally displaceable manner on a guide of the machine stand, passed freely through the cross-head and made to act with the piston rod of the closing piston directly on the moving die platen. To obtain a favorable energy balance on the closing side, a pressure intensifier may be used in the process. Stroke adjustments may be eliminated. The adjustment in height of the die is effected in that the closing cylinder performs the displacement of the moving die platen. This configuration has the advantage that in contrast to the known die-casting machines, significantly smaller masses must be moved, so that the drive required for the displacement, for example an electric motor, may be substantially smaller. The displacement may be effected, in a manner similar to the displacement of the casting cylinder, by means of gears and two toothed nuts. This configuration is very simple. The new system is especially advantageous when the machine columns must be pulled during a change of tools. In the new machine, nothing must be disassembled or loosened on the stationary rear die platen. Furthermore, the machine columns retain their constant length independently of the height of the die (measured in the longitudinal direction of the columns) that must be set. In this manner, for example, the measurement of the closing force by means of strain gauges is considerably facilitated.

In view of the lower casting force, the stationary die platen may be very thin. The liquid material is thus able to pass into the casting chamber in spite of the short casting strokes provided. The filling funnel may be continuously adjustable both in height and in the longitudinal direction.

A simple embodiment of the new machine may be obtained by maintaining the closing cylinder in a slide-like support plate displaceably on a guide, which is located in front of the cross-head standing on the machine stand. The moving die platen is supported displaceably on the machine columns, held fixedly in the cross-head and the stationary die platen, also supported on the machine stand. Finally, a multiplier piston may be provided in the closing cylinder, which, for example, if two pressures are used on the casting side, permits the application of a higher locking pressure on the closing side also.

BRIEF DESCRIPTION OF THE DRAWINGS

The invention is illustrated in the drawing by means of an example of the embodiment and explained in the description hereinbelow. In the drawing.

DETAILED DESCRIPTION OF A PREFERRED EMBODIMENT OF THE INVENTION

Figure 1:
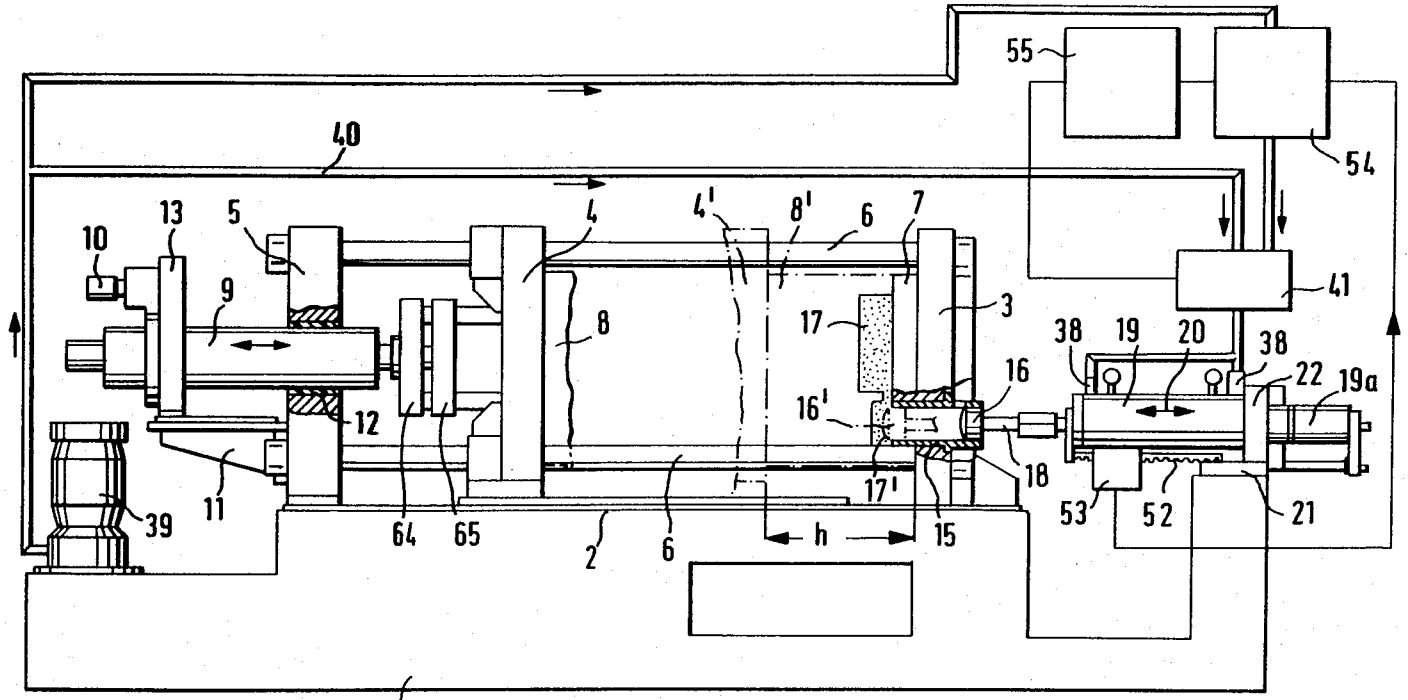
FIG. 1 shows a schematic, partially cut lateral elevation of an apparatus according to the invention for the production of die-cast parts with low casting pressures.

FIG. 1 shows a machine according to the present invention that may be used for pressure mold casting. In contrast to the known die-casting processes, the machine operates with a very low casting pressure, between 5 and 50 bar, preferably approximately 25 bar. As depicted in FIG. 1, a machine bed 2 is provided on a machine pedestal 1. The machine includes conventional components such as a stationary die platen 3, a moving die platen 4, and a cross-head 5 mounted on the machine bed 2. The cross-head 5 and the stationary die platen 3 serve as the holding means for the longitudinal machine columns 6. As is also conventional, one half 7 of the die is fixedly joined to the stationary die platen 3, and the other half 8 of the die is fastened to the moving die platen 4. As shown by the dash-and-dot line in FIG. 1, the moving die platen may be moved, for the casting process, to position 4', wherein the half dies 7 and 8' rest tightly against each other. This closing process for the die is effected by means of a closing cylinder 9, which displaces the moving die platen 4 directly along the columns 6, absent a knee lever system used in the known die-casting machines. To traverse the height h of the die, the entire closing cylinder 9, together with the moving die platen 4 attached to it, is displaced parallel to the columns 6 and relative to the cross-head 5. Movement may be achieved, for example, by means of a screw rod drive powered by an electric motor 10 mounted on a support pedestal 11. The closing cylinder 9 must be freely displaceable for this purpose through an orifice 12 in the cross-head 5, which therefore in the configuration of the present machine does not serve to rigidly mount the closing cylinder. The closing cylinder 9 is mounted on the support pedestal 11 by a slidable supporting plate 13, which in a manner not shown, is connected through the screw rod drive with the cross-head 5. A multiplier piston is provided in the closing cylinder, as shall be explained in relation to FIG. 6.

Through an orifice in the stationary die platen 3 and into the stationary half 7 of the die, a casting chamber 15 is inserted, in which a casting piston 16 is guided in a longitudinally displaceable manner. Both the casting chamber 15 and the casting piston 16 have very large cross-sections compared to the casting chambers and casting pistons of known die-casting machines, as low casting pressures are to be used, while casting times must be kept as short as possible. The casting capacity is thus obtained by the choice of large casting chambers and casting pistons. For example, the casting piston in a certain machine type may appropriately have a diameter of approximately 215 mm; the casting stroke, which may amount to a maximum of 230 mm therefore will be equal to 30 mm, with a die fill time of 100 ms (milliseconds) and a casting piston velocity of 0.3 m/s. In this manner, low fill velocities, for example, in the casting chamber a velocity of the melt, as moved by the piston of 0.1 to 0.4 m/s (milliseconds) may be obtained, in spite of short die filling times (between 10 and 100 ms). The filler orifice 15*a* (FIG. 2) of the casting chamber 15 is located on top. Here, the funnels for the introduction of the melt are applied. In the position indicated by the solid line in FIG. 1, the casting piston 16 is in the initial position, in which the melt is filled into the casting chamber and subsequently pressured by the casting piston into the cavity 17 of the die, until the casting piston 16' is pressing against the runner slug 17' of the workpiece. In this terminal position, indicated by a dash-and-dot line, the piston is therefore located in part in the die cavity of the moving half of the die.

Figure 5:
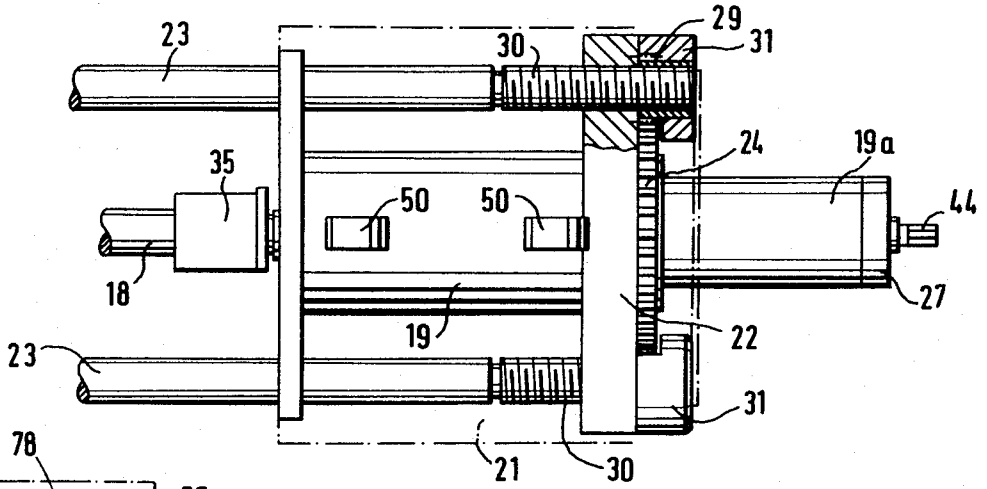
FIG. 5 is a top view of the casting cylinder in the direction of the arrow V of FIG. 2.

The casting piston 16 is actuated by means of a piston rod 18 from the casting cylinder 19, the configuration of which shall be explained in detail in relation to FIGS. 2 to 5. The casting cylinder 19 is displaceable on a guide 21 in the longitudinal direction, i.e., movable in the direction of the arrows 20 (FIG. 1) parallel to the axis of the piston rod 18, so that the initial position of the casting piston 16 may be set. The guide 21 is joined fixedly to the machine pedestal 1. The casting cylinder 19 is fastened to a slide 22 in the form of a guide plate, which moves in a manner to be explained hereinbelow along two stationary guide columns 23, not shown in FIG. 1 but visible in FIG. 5. This movement is obtained in that, as shown in FIGS. 2 to 5, a manually actuated drive gear is associated with the plate-like guide slide 22. That drive gear comprises a toothed wheel 24 coaxial with the axis of the piston rod 18, and a drive pinion 25 for the toothed wheel. The pinion is rotated by a shaft 26 supported at the end 19*a* of the casting cylinder in a laterally projecting holder 27 and actuable by a manual crank 28'. Two smaller toothed gears 29 oppose each other diametrically at the height of the axis 28 of the piston rod. The gears 29 have the same number of teeth and are equipped on their internal diameter with threads of equal configuration, engaging threads 30 at the end of the guide rods 23 (FIG. 5).

The toothed gears 29 are secured axially to the slide 22 by the guide sleeves 31 fastened fixedly to the slide 22. Thus, during a rotating motion of the shaft 26, the slide 22 will be displaced relative to its guide 21 and relative to the a drive piston 37. If a pointer 33 is connected with the slide 22 (FIG. 3) and the guide 21 is provided with a scale 34, the prevailing position of the casting cylinder 19 relative to the stationary die platen 3 may be read directly. The front end of the casting cylinder defines a terminal stop 19B for the drive piston during its travel toward the stationary platen 3.

Figure 2:
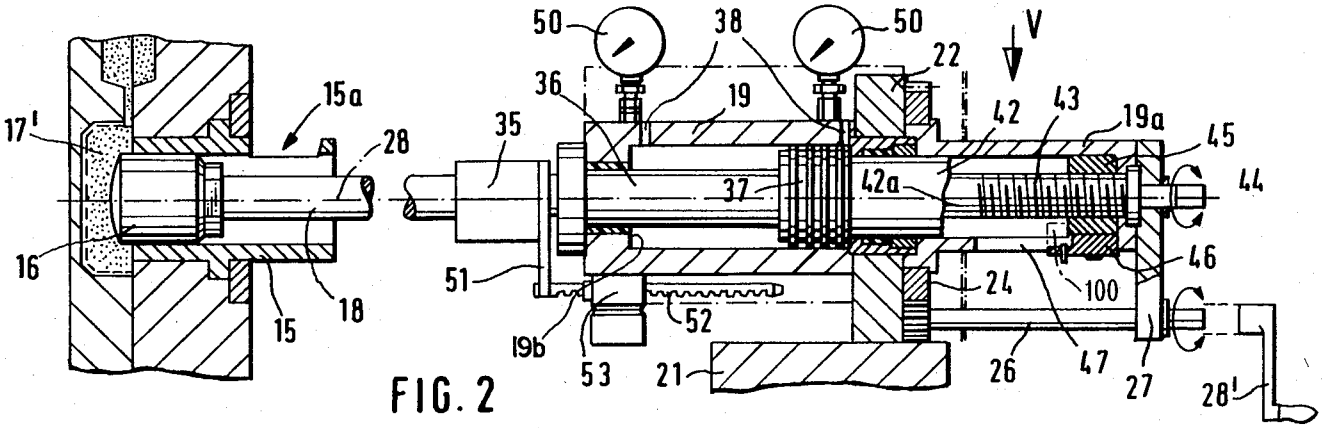
FIG. 2 is an enlarged view of the casting unit comprising the drive piston with the piston rod, casting cylinder and the casting chamber with the casting piston.
Figure 3:
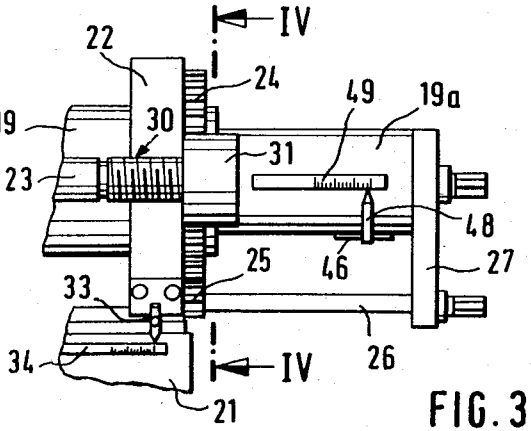
FIG. 3 is a partial view of the casting cylinder facing away from the casting piston in the uncut state.
Figure 4:
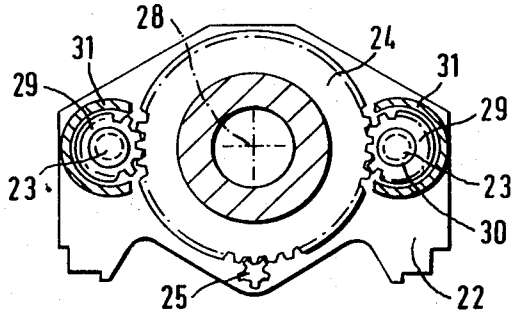
FIG. 4 is a sectional view tkaen through the casting piston on the line IV—IV of FIG. 3.

As seen in FIG. 2, the piston rod 18 of the casting piston 16 is connected by means of a clutch 35 with the piston rod 36 of the drive piston 37, arranged displaceably in the axial direction in the casting cylinder 19. The drive piston 37 is pressured by a hydraulic pressure medium, which may be introduced through feed bores 38 into the cylinder space within the casting cylinder 19. This hydraulic pressure medium is supplied by a hydraulic pressure pump 39, which in a known manner advances the pressure medium through a line 40 to a control valve 41 and from there to the two connections 38.

The drive piston 37 is in the form of a double-acting piston, and the piston rod 36 includes an extension 42 on the side facing away from the casting piston 16. This extension 42 is hollow and has a larger diameter than the piston rod 36. Thus, it is possible to operate with a low advancing force for the casting piston 16, but to apply a significantly higher return force on the casting piston 16, after the terminal position thereof shown in FIG. 2 is reached. Such return force serves to satisfactorily release the casting piston from the runner slug 17', without the risk of a so-called relaxation impact in the configuration chosen. The rear part of the piston rod in the form of a hollow extension 42 preferably receives a screw rod 43, which is guided rotatingly to the outside through the end 19*a* of the casting cylinder and is turned there by means of a square rod with the crank 28'. The screw rod 43 rotates freely inside the cavity 42*a* of the extension 42, but is actively connected with a nut 45, having an extension 46 in the downward direction in the form of a sliding block, guided in a longitudinal groove 47 in the end part 19*a* of the casting cylinder 19. The nut 45 thus cannot be rotated, but it may be displaced by the actuation of the screw rod 43. The nut 45 serves as one terminal stop for the movement of the extension 42 and its drive piston 37 and thus for the motion of the casting piston 16. The position of the nut within the end part 19*a* may be read on the outside by means of a pointer 48, which is fixedly connected with the sliding block 46 and cooperates with a scale 49 mounted outside on the end part 19*a*. The pressure of the hydraulic medium moving the drive piston 37 may be read on the manometers 50 arranged in the two inlet orifices 38.

As a result of the above-described arrangement, both the starting point and the end point of the stroke movement of the casting piston 16 can be varied as desired. The new machine may thus be operated with different casting chamber 15 and casting pistons 16, so that with the same machine, a whole range of different dies may be employed.

In the embodiment shown, a rack 52 is further connected with the piston rod 18 and the clutch 35, fixedly by means of an arm 51. The rack is aligned parallel to the axis 28 of the casting cylinder 19. This rack cooperates with a counter, actuated for example electromagnetically, which receives a counting pulse upon the passage of each tooth of the rack 52, thereby making possible the accurate detection of the stroke covered by the casting piston 16. In this regard, a pulse generator 53 is mounted on the cylinder 19 and is connected, as seen in FIG. 1, with a conventional pressure amplifier mechanism 54 which serves to increase the hydraulic pressure, the mechanism 54 receiving its starting signal from the pulse generator 53. Preferably, however, the higher casting pressure is applied to the drive cylinder 37 and thus to the piston 16 only when a delay element 55 has given a start command to the control valve 41 to release the higher pressure to the casting cylinder 19. This delay element is laid out so that the higher casting pressure occurs only, when (depending on the workpiece) the material in the die has solidified to the extent that a displacement of the sand cores (if such are used) by the increased pressure is safely prevented.

The arrangement described thusfar has the advantage that different casting strokes may be effected with the same machine and that both the end of the casting piston stroke and the onset of the casting stroke may be adapted to different dies by an adjustment of the entire casting unit. The surveillance of the stroke path and the detection of the end of the stroke provide the advantage that a second, higher casting pressure may be applied to the workpiece, in order to obtain an improved surface condition of the casting. Conveniently, the transducer is connected with an adjustable time delay element, which conducts the pulse coming from the transducer when the casting piston has attained its terminal position after filling the die and is pressing against the runner slug. The time delay device is connected to a device that amplifies the pressure acting on the drive piston. This arrangement results in the advantage that the delay time may be chosen long enough to assure that the higher pressure will actually be applied only when, for example, a sand core used in the mold can no longer be displaced, because it is already fully embedded in the material filled-in; the higher pressure is then counter-acting the shrinkage by means of the additional supply of melt introduced by it.

The particular configuration of the drive piston makes it possible to obtain a high return force, in spite of a low casting force and with the same working pressure of the hydraulic medium that is used preferentially.

Since in the present apparatus for the production of die-cast parts, the casting piston is acting on the melt during the filling of the die with a low force only and thus the process is operated with a slight casting force, no high locking forces are required on the locking part of the die. According to the invention, therefore, the locking part may be in the form of a frictionally locking lever system of the die-casting machine.

Figure 6:
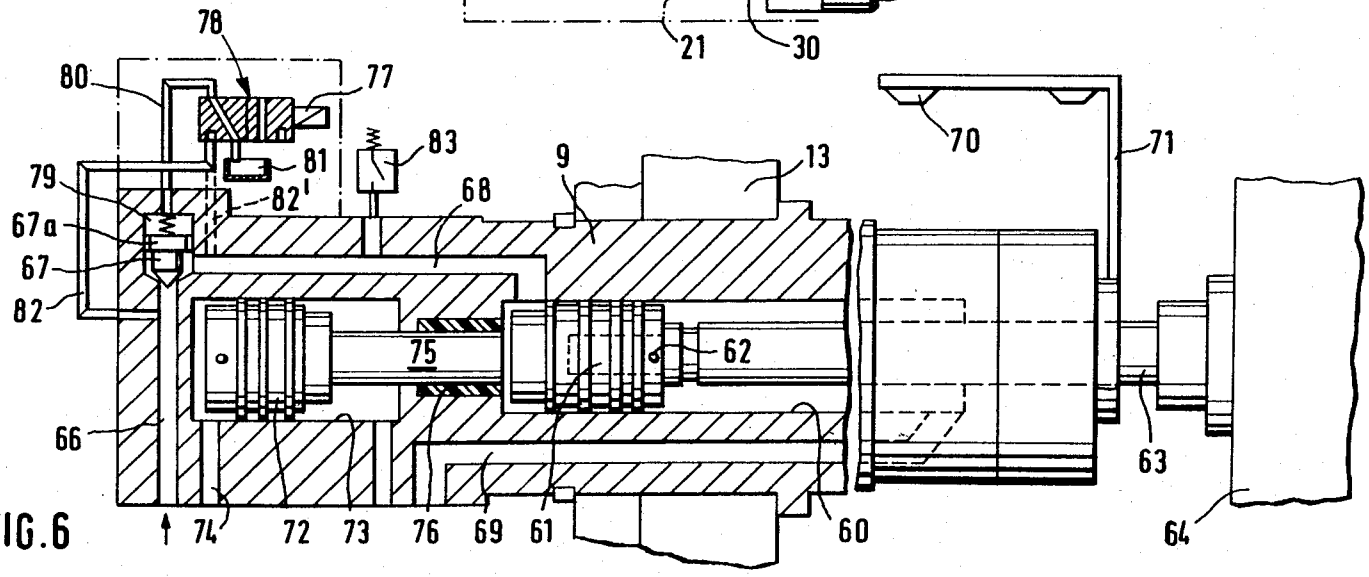
FIG. 6 depicts the closing cylinder with a multipler piston in an enlarged and partially sectioned lateral elevation.

FIG. 6 shows that the closing cylinder 9, held in the support plate 13, is equipped with an internal cylinder chamber 60, in which a closing piston 61 is guided in a displaceable manner. The closing piston 61 is connected with a fastening plate 64 joined fixedly to the die platen 4, for example, by means of the piston rod 63 which is screwed into the piston 61 and secured by a pin 62. An ejector plate 65 is connected in a known manner to the fastening plate 64, by means of suitable pressure cylinders. Following the opening of the die, the plate 65 serves to eject the workpiece. The cylindrical chamber 60 in the closing cylinder 9 is supplied with a hydraulic medium under pressure through the pressure line 66, the medium being conducted, upon a closing start command, past the seat valve 67 and through the channel 68 into the space to the left of the closing piston. The closing piston thus moves under pressure to the right and closes the die. In the course of this action, the hydraulic medium in the chamber 60 on the other side of the closing piston 61 is drained through the line 69.

The size of the closing piston makes it possible to operate with higher closing velocities. At the termination of the closing process, the cam 70, fixedly connected, for example by means of an angle member 71, with the piston rod 63, may actuate a switch, which releases a signal to increase the pressure on the closing piston 61.

The pressure increase is effected by means of a multiplier piston 72, which is arranged in a further cylindrical chamber 73 in the closing cylinder 9. Following the actuation of a switch by the cam 70, the hydraulic fluid is supplied to the chamber 73 at the pressure under which it is available from the pressure reservoir, i.e., the pressure pump 39 shown in FIG. 1. The multiplier piston 72 has a piston rod 75, that may travel into the cylindrical chamber 60 of the closing piston 61, when the multiplier piston 72 is under pressure. The piston rod 75 is displaceably guided within a gasket 76 in the closing cylinder 9 and enters the chamber 60 in the manner of a plunger. The chamber 60 is filled with the hydraulic fluid on the left side of the closing piston 61, when the latter is in its terminal position. A translation of the piston/rod 72, 75 is obtained by virtue of the smaller diameter of the piston rod 75 compared with the diameter of the multiplying piston 72. In the work space of the closing piston 61, therefore, a multiplying pressure may be obtained. To render this possible, the line 66 to the closing piston 61 must be closed. This is effected by the signal of the switch actuated by the cam 70, which switch activates the electromagnet 77 of an electromagnetic slide valve. The electromagnet 77 moves the valve from the position shown (i.e., in which the space 79 behind the seat valve 67 is connected through a return line 80 with the tank 81) into a position wherein the pressure prevailing in the line 66 is applied through a branch line 82 to the space 79 of the seat valve 67. As the piston surface area **67*a* of the seat valve 67 is larger than the annular surface facing the chamber 79 of the piston 67*a*, the seat valve is pressured automatically in the closing position. In the part of the cylinder chamber 60, to the left of the closing piston 61, the multiplying pressure may thus be produced. By means of a pressure switch 83, set on the line 68**, a signal may be released to the casting side, when the multiplying pressure is attained. The casting unit may then begin to operate.

Since the electromagnetic valve 78 is exposed to the multiplying pressure, which in contrast to the working pressure may attain approximately 550 bar, the electromagnetic valve 78, as indicated by the dash-and-dot line, may conveniently be integrated in the housing of the closing cylinder 9. However, to better demonstrate its function, in FIG. 6 only the schematic functional representation of the electromagnetic valve 78 is given.

It is also possible, as indicated by a broke line in FIG. 6, to let the branch line 82' open not into the pressure line in front of the seat valve 67, but into the channel 68, in which the increased multiplier pressure is produced. The seat valve 67 is maintained more securily in such a solution in the closing position.

The above-described arrangement is especially advantageous, when the machine columns must be pulled during a change of tools. That is, nothing must be disassembled or loosened on the stationary rear die platen. Furthermore, the machine columns retain their constant length independently of the height of the die (measured in the longitudinal direction of the columns) that must be set. In this manner, for example, the measurement of the closing force by means of strain gauges is considerably facilitated. In view of the lower casting force, the stationary die platen may be made very thin.

It should be noted that the sliding block 46 may be provided with a terminal switch 100 (shown in phantom in FIG. 2) which is engaged by the piston rod 42 to signal when the casting piston has reached its rearmost position.

Although the present invention has been described in connection with a preferred embodiment, it will be appreciated by those skilled in the art that modifications, substitutions, deletions, and additions, may be made without departing from the spirit and scope of the invention as defined in the appended claims.

What is claimed is:

1. Apparatus for the production of die-cast parts comprising:

a die including movable and stationary die half sections mounted on movable and stationary die platens, respectively, said die half sections defining a die cavity, a casting unit comprising a casting chamber mounted on said stationary die platen and a casting piston movable in said casting chamber for filling said die cavity with melt, said casting piston having a relatively large cross-section and being arranged for travel into said movable die half section during a die cavity filling step after said die half sections have been mated, a drive piston connected to said casting piston for moving the latter, a casting cylinder receiving said drive piston and being mounted on a guide for movement in the direction of the axis of said drive piston, said casting cylinder carrying first and second terminal stops defining the final and initial locations of the stroke of said drive piston, means for independently adjusting said first and second stops relative to said die and said drive piston and relative to each other whereby the final and initial positions of said casting piston can be independently adjusted, and the length of the stroke of said casting piston can be adjusted, means for supplying pressure to said drive piston within said casting cylinder, means supporting said casting cylinder for adjustment relative to said drive piston in the direction of said drive piston, and signal generating transducer means for sensing the position of said casting piston relative to said die for determining the position of said casting piston within said movable die half section.

2. Apparatus according to claim 1, wherein said movable die half section includes a runner slug into which said casting piston can enter, said pressure supplying means including amplifying means for amplifying the pressure supplied to said drive piston, said transducer means being operably connected to said amplifying means to activate the latter and increase the pressure supplied to said drive piston when said casting piston engages said runner slug after filling said die cavity with melt.

3. Apparatus according to claim 1, wherein said drive piston comprises a double-acting piston having first and second piston rod portions extending from opposite sides thereof, said first piston rod portion serving to connect said drive piston with said casting piston and having a smaller diameter than said second piston rod portion, the latter being arranged to abut said second terminal stop.

4. Apparatus according to claim 3, wherein said second piston rod portion is hollow, a rotatable screw rod projecting into said hollow rod portion, a stop nut defining said second terminal stop being adjustably mounted on said screw rod for longitudinal movement thereon.

5. Apparatus according to claim 4, wherein said stop nut is mounted on a sliding block which is longitudinally slidable in a guide groove of said casting cylinder.

6. Apparatus according to claim 5, wherein said sliding block carries a pointer cooperating with a scale on said casting cylinder.

7. Apparatus according to claim 6, wherein said casting cylinder is mounted on a slide which is carried by said guide, and gear means for adjusting said slide along said guide.

8. Apparatus according to claim 7, wherein said gear means comprises a rotatable shaft displaceable with said slide, a pinion mounted on said shft, a tooth gear movable with said slide and meshing with said pinion and with two toothed gears mounted on said slide, said two toothed gears being mounted on stationary guide shafts such that rotation of said rotatable shaft produces movement of said slide along said guide shafts.

9. Apparatus according to claim 7, wherein said slide carries a pointer which cooperates with a scale on said guide.

10. Apparatus according to claim 1, wherein said transducer means comprises a pulse generator, a toothed rod mounted on said piston rod and being engageable with said pulse generator such that the teeth on said toothed rod are sensed by said pulse generator.

11. Apparatus according to claim 2, wherein said transducer means comprises a pulse generator, a toothed rod mounted on said piston rod and being engageable with said pulse generator such that the teeth on said toothed rod are sensed by said pulse generator.

12. Apparatus according to claim 1, further comprising a closing unit which includes a closing cylinder and a closing piston slidable in said closing cylinder and operably connected to said movable die half section to displace the latter, said movable die half section being guidingly supported on columns which are mounted on a cross-head, said closing cylinder being slidably mounted on a guide and extending through said cross-head and mounted for sliding movement therein.

13. Apparatus according to claim 12, wherein said closing cylinder is mounted on a slide which slides upon said guide.

14. Apparatus according to claim 12, wherein said columns are connected to said stationary die platen, said stationary die platens being mounted on a machine bed.

15. Apparatus according to claim 14, including a multiplier piston mounted in said closing cylinder, and means for actuating said multiplier piston to increase the force applied thereby to said movable die half section simultaneously with the amplification of forces applied to said casting piston.

16. Apparatus according to claim 1, wherein the cross-section of said casting piston is of a size which provides a die fill time of between 10 and 1000 milliseconds at a velocity of the casting piston between 0.1 and 0.4 milliseconds.

17. Apparatus according to claim 16, wherein the stroke of the casting piston is from 40 to 230 mm and the casting pressure is from 5 to 25 bar.

18. Apparatus according to claim 1, wherein said second stop has a switch thereon which generates a signal in response to the arrival of the casting piston in its initial location.

* * * * *